United States Patent [19]

Suzuki et al.

[11] Patent Number: 4,902,247

[45] Date of Patent: Feb. 20, 1990

[54] ELECTRICAL CONNECTOR

[75] Inventors: Izumi Suzuki; Hideki Ogawa, both of Suzuka, Japan

[73] Assignee: Sumitomo Wiring Systems, Japan

[21] Appl. No.: 206,222

[22] Filed: Jun. 13, 1988

[30] Foreign Application Priority Data

Jun. 16, 1987 [JP] Japan ..... 62-149830

[51] Int. Cl.[4] ..... H01R 13/40

[52] U.S. Cl. ..... 439/595; 439/598

[58] Field of Search ..... 439/592–595, 439/597, 598

[56] References Cited

U.S. PATENT DOCUMENTS

| | | | |
|---|---|---|---|
| 4,614,390 | 9/1986 | Baker | 439/592 |
| 4,711,509 | 12/1987 | Cross et al. | 439/595 |
| 4,721,482 | 1/1988 | Fukuda et al. | 439/595 |
| 4,758,182 | 7/1988 | Anbo et al. | 439/598 |
| 4,776,813 | 10/1988 | Wilson et al. | 439/595 |

*Primary Examiner*—P. Austin Bradley

*Attorney, Agent, or Firm*—Jordan B. Bierman

[57] ABSTRACT

An electrical connector, particularly adapted for use in motor vehicles, having an outer wall, a housing cap adapted to cover the front end of the housing, and one or more wire assemblies each having a terminal recess on the inside surface thereof. The assembly is adapted to be inserted into the housing from the rear and the housing has a corresponding number of receiving passages extending longitudinally therethrough. There is a narrowed portion of the passages which forces the assemblies being inserted outwardly against a deflectable arm in the outer wall. When the assembly is completely in place, the narrowed portion fits into the terminal recess, thereby permitting the flexible portion of the outer wall to return to its normal position. Thus, unless the assemblies are fully seated, the housing cap cannot be fitted over the housing, thereby preventing misassembly of the connector.

10 Claims, 5 Drawing Sheets

ELECTRICAL CONNECTOR

This Application claims the benefit of the priority of Japanese Application 149,830, filed June 16, 1987.

The present invention is directed to an improved electrical connector, more specifically one which is particularly suitable for use in motor vehicles.

DESCRIPTION OF THE PRIOR ART

A conventional connector assembly is shown in U.S. Pat. No. 4,621,883. The reference describes a connector having two mateable housings with a sealing gasket therebetween. The gasket is located in a blind cavity in one housing and is compressed axially between the housings and radially between a shroud on one housing and a wall of the blind cavity. As can be seen in FIG. 5 of the reference, the surfaces of the sealing ring facing the inner wall of the housing are formed with an annular groove which receives a complementary extending rib on the opposed inner wall. In this manner, the sealing ring is secured in the cavity.

U.S. Pat. No. 3,686,619 teaches a connector having a plurality of rows of parallel openings to accommodate interfitting electrical terminals. Between the ends of the terminals are zones of reduced cross section and the walls include a deflectable arm having a projection which extends inwardly in a reduced cross section zone of the terminal. This provides a releasable latch for the terminals.

The patent to Cairns (U.S. Pat. No. 3,601,760) teaches a connector having a terminal with an annular recess and a block of non-conductive material having an opening therein to receive the terminal. A flexible wall defines a portion of the length of the terminal receiving aperture of the block and a locating tab is secured thereto. This is designed to enter the annular recess in order to lock the portions of the connector together. Means is provided in order to prevent flexing of the wall when the terminal is properly positioned within the aperture.

SUMMARY OF THE INVENTION

The present invention is directed to an electrical connector having reduced space in its terminal passages and flexible walls whereby mating of the housing and housing cap is prevented unless the wire assemblies are in their proper positions. In addition, there is provided means for holding a sealing member to the connector housing without compression by the wall thereof.

Also, grooves are provided on the outer wall of the housing cap with complementary ridges on the coupling member. The number and spacing of these are used in order to identify the portions of the connector and prevent mismating of connector halves.

BRIEF DESCRIPTION OF THE DRAWINGS

In the accompanying drawings, constituting a part hereof, in which like references represent like parts.

DETAILED DESCRIPTION OF THE INVENTION

Figure 1:
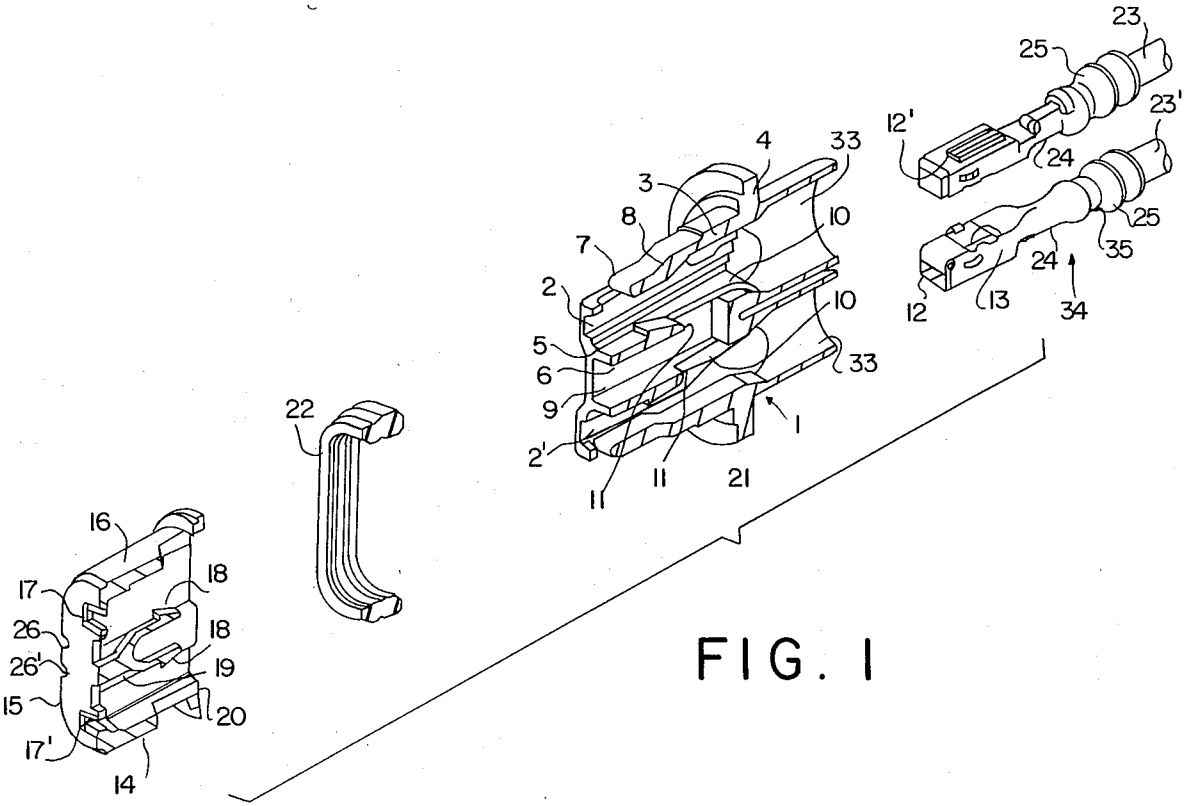
FIG. 1 is an exploded perspective view of the connector of the present invention.
Figure 3:
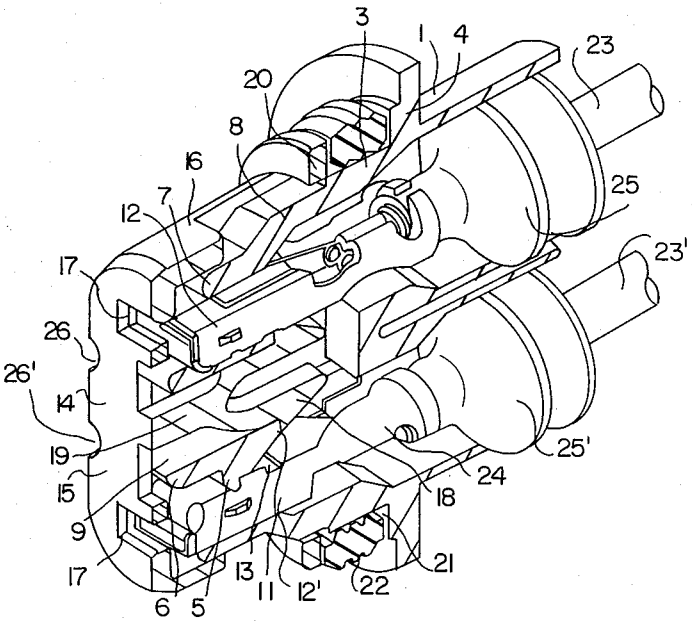
FIG. 3 is a perspective view, similar to that of FIG. 2, but showing the connector fully assembled.

As can best be seen in FIG. 1, the connector of the present invention comprises housing 1, housing cap 14, and wire assemblies 34. Housing 1 has receiving passages 2 and 2' and flange 4 on central wall 3. Passages 2 and 2' are each provided with projection 5 which narrows passages 2 and 2' at one point. Approximately radially outwardly of projection 5 is deflectable arm 8 terminating in free end 7. Rear openings 33 are provided at the rear of housing 1.

Wire assemblies 34 comprise lead wires 23 and 23' which are connected to electrical terminals 12 and 12'. Terminal recesses 24 are located intermediate the ends of wire assemblies 34 and ferrule 35 is located adjacent sealing plugs 25 and 25'.

Housing cap 14 comprises end wall 15 and side wall 16. Cap openings 17 and 17' are formed in end wall 15. Extending substantially axially from end wall 15 is deflectable element 19 carrying locking projections 18. Sealing ring 22 is adapted to embrace housing 1 at central wall 3 in recess 21 between central flange 4 and cap flange 20. Grooves 26 and 26' are provided in side wall 16 to receive complementary members 29 and 29' which are located on the inside of mating connector 27. (See FIG. 4)

To assemble the connector, wire assemblies 34 are inserted into rear openings 33 of housing 1. Upon electrical terminals 12 and 12' reaching blocking portions 11, the inclined plane thereof forces them outwardly against deflectable arms 8. These then assume the position shown in the upper half of FIG. 2 with free end 7 projecting radially outward from housing 1.

As the insertion is continued to the ultimate desired position of wire assemblies 34, terminal recesses 24 receive projections 5. This permits wire assemblies 34 and, in particular, electrical terminals 12 and 12', to move radially inward. Thus, locking portions 11 hold assemblies 34 and prevent them from being removed. At the same time, deflectable arm 8 and free end 7 return to their original position so that they no longer project outwardly of housing 1.

Sealing ring 22 is then placed around central wall 3 adjacent housing flange 4. As housing cap 14 is slid over the front end of housing 1, side walls 6 of pocket 9 bear against the inclined face of locking projections 18. This causes them to move inwardly to assume the position shown in FIG. 2. As cap 14 continues its movement onto housing 1, locking projections 18 reach gaps 10 and flex outwardly to engage side walls 6 and, thereby, lock cap 14 to housing 1.

Figure 2:
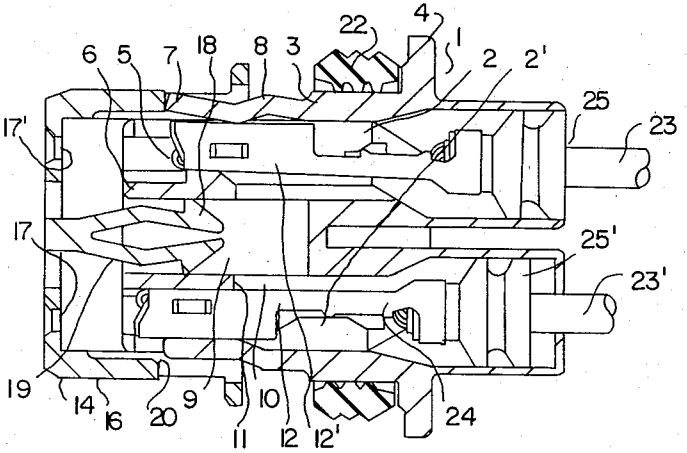
FIG. 2 is a cross section of the connector partially assembled.

It is a feature of the present invention, as shown in FIG. 2, that it is not possible to place cap 14 on housing 1 unless terminals 12 and 12' are fully seated in housing 1. The upper half of FIG. 2 shows free end 7 projecting outwardly of housing 1 and abutting cap flange 20, thereby preventing cap 14 from being placed on housing 1. Thus, the unit cannot be misassembled.

It is a further feature of the present invention that sealing ring 22 is retained in position between cap flange 20 and housing flange 4. No compression, special ribs, or slots are required.

When wire assemblies 34 are properly in position within housing 1, sealing plugs 25 bear firmly against the inner walls of rear openings 33. Thus, plugs 25 effectively prevent the entry of water from the rear and sealing ring 22 similarly prevents entry of water from the front of the connector.

In the present construction, sealing ring 22 is effectively retained between cap 14 and flange 4. Since the former is not removed during connection and disconnection with the mating connector, there is no opportunity for sealing ring 22 to be removed inadvertently from housing 1.

Figure 4:
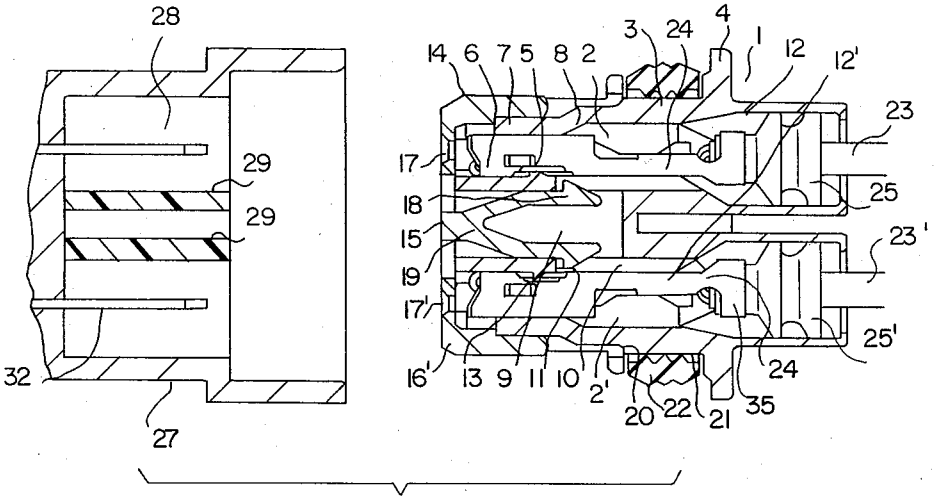
FIG. 4 is a sectional view of the assembled connector and a mating connector intended to be used therewith.
Figure 6A:
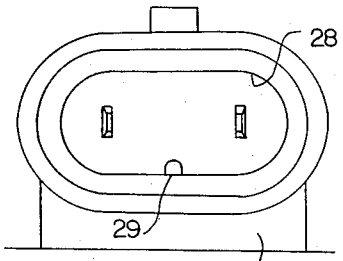
FIGS. 5 and 6 are end views of the assembled connector of the present invention and mating connectors.
Figure 6B:
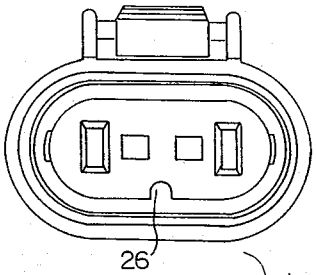
Figure 5B:
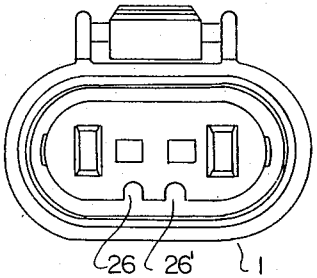
Figure 5A:
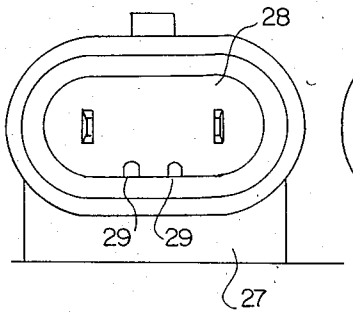
Figure 7:
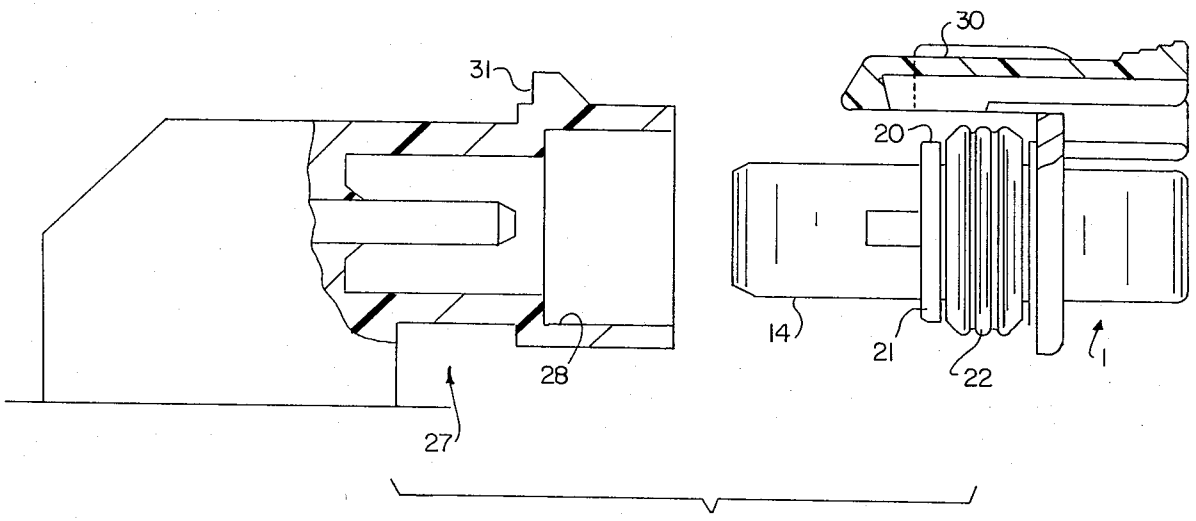
FIG. 7 is a schematic partial view showing the locking arrangement between the connector of the present invention and a mating connector.

After assembly, the connector of the present invention is adapted for mating with mating connector 27 which has mating portion 28 and locating pins 32 (see FIG. 4). As is shown in FIG. 7, lock arrangement 30, as the inventive connector and mating connector 27 are engaged, rides over the front face of lock projection 31 to hold the portions together.

While only a limited number of embodiments of the present invention have been expressly disclosed, the invention is, nonetheless, to be broadly construed and not to be limited except by the character of the claims appended hereto.

What we claim is:

1. An electrical connector comprising a housing having an outer wall, a housing cap adapted to cover a front end of said housing by movement along a longitudinal path located radially outward of said housing, at least one wire assembly having a terminal recess on an inside surface thereof, said assembly having a terminal adapted to enter said housing from a rear end remote from said front end, said housing having at least one receiving passage extending longitudinally therethrough and having an inner wall and an inner surface, a deflectable arm in said outer wall, a blocking portion on said housing and projecting into said passage, said blocking portion forcing said deflectable arm outwardly into said path as said assembly is inserted into said passage until said assembly reaches a predetermined position wherein said assembly is fully seated, whereupon said blocking portion is received in said terminal recess and is no longer in said path, whereby said cap cannot be seated on said front end unless said assembly is in said predetermined position.

2. The connector of claim 1 wherein there are two said wire assemblies.

3. The connector of claim 1 wherein there is an equal number of said assemblies and said receiving passages.

4. The connector of claim 1 comprising a sealing means embracing said housing and located between a face of said cap nearest said rear end and a flange surrounding said housing, said flange being between said front end and said rear end.

5. The connector of claim 1 wherein said cap has at least one locking projection extending substantially axially thereof, said locking projection including a deflectable element having a detent head at an end of said deflectable element nearer said rear end, a pocket having sidewalls in said housing opening toward said front end and adapted to receive said locking projection, a gap in said side walls adapted to receive said detent head, whereby said cap is locked to said housing.

6. The connector of claim 5 wherein there are two said locking projections and said gaps are complementary thereto.

7. The connector of claim 1 wherein said assembly comprises at least one plug at or adjacent a back of said assembly remote from said terminal, said plug adapted to contact said inner wall of said receiving passage.

8. The connector of claim 7 wherein there are two said plugs spaced apart longitudinally.

9. The connector of claim 1 wherein at least one rib or channel is provided on a surface of said housing cap and at least one complementary rib or channel is provided on a complementary surface of a mating connector.

10. The connector of claim 9 wherein there is one rib or channel on said inner surface of said housing and one rib or channel on an outer surface of said mating connector.

* * * * *